US007410383B2

(12) United States Patent
Hsieh

(10) Patent No.: US 7,410,383 B2
(45) Date of Patent: Aug. 12, 2008

(54) ELECTRICAL CONNECTION GUIDE MEMBER

(75) Inventor: Chi-Kang Hsieh, Taipei (TW)

(73) Assignee: Inventec Corporation, Taipei (TW)

( * ) Notice: Subject to any disclaimer, the term of this patent is extended or adjusted under 35 U.S.C. 154(b) by 0 days.

(21) Appl. No.: 11/732,876

(22) Filed: Apr. 5, 2007

(65) Prior Publication Data

US 2008/0124967 A1 May 29, 2008

(30) Foreign Application Priority Data

Nov. 23, 2006 (TW) ..... 95220653 U

(51) Int. Cl.
*H01R 13/64* (2006.01)

(52) U.S. Cl. ..... 439/374

(58) Field of Classification Search ..... 439/374, 439/377

See application file for complete search history.

(56) References Cited

U.S. PATENT DOCUMENTS 3,966,290 A * 6/1976 Little et al. ..... 439/74
4,350,401 A * 9/1982 Allen et al. ..... 439/374
4,722,698 A * 2/1988 Modschiedler ..... 439/374
5,137,467 A * 8/1992 Arai ..... 439/374
5,486,118 A * 1/1996 Colleran et al. ..... 439/374
5,655,914 A * 8/1997 McCartin et al. ..... 439/78
5,697,805 A * 12/1997 Orstad et al. ..... 439/374
5,785,536 A * 7/1998 McCartin et al. ..... 439/78
6,146,184 A * 11/2000 Wilson et al. ..... 439/374
6,361,350 B2 * 3/2002 Johnson et al. ..... 439/374
6,435,897 B1 * 8/2002 Paul et al. ..... 439/374

FOREIGN PATENT DOCUMENTS

TW 399802 7/2000
TW M288034 2/2006

* cited by examiner

*Primary Examiner*—Gary F. Paumen
(74) *Attorney, Agent, or Firm*—Peter F. Corless; Steven M. Jensen; Edwards Angell Palmer & Dodge LLP

(57) ABSTRACT

An electrical connection guide member guides insertion of an electrical connecting portion of an electronic apparatus to a complementary mating electrical connector having a first retention portion provided on a sidewall thereof. The guide member includes a connecting board; two opposed sideboards each vertically connected with two ends of the connecting board, wherein two opposed ends at one end of the two sideboards constitute a receiving opening, at least one fixing portion is disposed on one of the sideboards and corresponding to the receiving opening for fixing the complementary mating electrical connector; and a second retention portion is disposed on an inner surface of one of the sideboards and corresponding to the first retention portion; and a plurality of first guide portions disposed on the inner surface of one of the two sideboards for guiding insertion of an electrical connecting portion into a complementary mating electrical connector or connecting device.

8 Claims, 3 Drawing Sheets

ELECTRICAL CONNECTION GUIDE MEMBER

BACKGROUND OF THE INVENTION

1. Field of the Invention

This invention generally relates to the art of electrical connectors and, particularly, to a guide means for a complementary mating connector or other connecting device that facilitates guiding a pair of connectors into mated condition as well as securing the connectors in the mated condition.

2. Description of Related Art

A typical server unit includes a backplane for installation and maintenance purposes, wherein one side of the backplane is electrically connected to the motherboard of the server while the other side comprises a plurality of electrical connecting portions for hot-plugging to storage devices. The housing of the server unit comprises a plurality of slots for correspondingly receiving storage devices therein for allowing each storage device to be appropriately connected to electrical connecting portions in the backplane of the server unit. For the convenience of adding storage devices or other electronic devices, space is reserved in the front of the server unit. However, the enclosure for such a space does not provide retention mechanisms for the added devices, thus, when installing an electronic device from the front of the server unit, it is often difficult to align the electronic device with the electrical connecting portion located in the backplane of the server unit for electrical connection due to the inherent physical difference existing therebetween, resulting in a poor quality electrical connection when the connectors are not properly connected.

In addition, in some applications, the locations of electrical connectors often make it very difficult to accurately align a pair of mating connectors prior to or during mating. This particularly may be a problem where at least one connector in a mateable pair is mounted to a panel that prevents accurate visual alignment during mating, or the connector is in a cumbersome or awkward location. Consequently, a guiding means on one or both of the connectors is often desirable to facilitate either blind mating or mating of the connectors in awkward locations.

Taiwanese Patent Publication No. 399802 discloses a technique in guiding connectors for electrical connection, wherein a guide device is inserted into a socket to guide the connector of a sub-board into the socket. However, it is difficult to manufacture such guide devices for small-size sockets, and, also, there is hardly any tolerance available since such a guide device is to be installed in the socket.

Presently, there is a so-called built-in electrical connector available on the consumer market to increase the convenience of using electronic cards. Such connectors are typically welded to the backplane of an electronic device, and users have to exert care during insertion of an electronic card to prevent damage to the connector or the electronic card due to incomplete or erroneous insertion.

Taiwanese Utility Model No. M288034 discloses a guide device for guiding connectors of electronic cards comprising a mating electronic card connector for guiding the frame body of the electronic card and two arms each disposed on both sides of the frame body to secure the connector. These types of connector structures provided with clamping arms for fixing the connector often have insufficient stability that can adversely affect the performance of the electronic card, or exhibit the disadvantage of wasting material if the length of the arms is to be extended to increase stability.

Other connectors require some form of guiding mechanisms to guide the pair of connectors into mated condition and, thereby, ensure that the terminals are properly aligned and interconnected. For instance, one connector of a connector assembly may include one or more guide holes for receiving complementary guide pins projecting from the mating connector. Such guiding mechanisms require space or occupy a considerable area of the connectors.

Therefore, it is desirable to develop a novel and improved mechanism that can solve the drawbacks of the prior art discussed above.

SUMMARY OF THE INVENTION

It is an objective of the present invention to provide an electrical connection guide member that facilitates insertion of an electrical connecting portion into an electrical connector.

Another objective of the present invention is to provide an electrical connection guide member capable of tolerating wide-ranging differences in connecting with a complementary mating connector or other connecting device.

Another objective of the present invention is to provide an electrical connection guide member that helps to save material costs.

Another objective of the present invention is to provide an electrical connection guide member that provides a secure and effective connection of an electrical connecting portion to an electrical connector.

In order to achieve the above and other objectives, the present invention provides an electrical connection guide member for guiding a pair of complementary mating electrical connectors or other connecting devices into mated condition. The guide member is adapted to guide insertion of an electrical connecting portion of an electronic apparatus to a complementary mating electrical connector having a first retention portion provided on a sidewall thereof, comprising a connecting board having two opposed ends and an inner surface; two opposed sideboards each having a first end, a second end and an inner surface, the two opposed sideboards being vertically connected with the two opposed ends of the connecting board at the first end and the second end respectively, to form with the connecting board a rectangle-shaped receptacle for accommodating the complementary mating electrical connector, the second ends of the two sideboards constituting a receiving opening abutting the rectangle-shaped receptacle for receiving the complementary mating electrical connector therein; a second retention portion disposed on inner surfaces of the two opposed sideboards and corresponding to the first retention portion of the complementary mating electrical connector; at least one fixing portion disposed on one of the sideboards and corresponding to the receiving opening for fixing the complementary mating electrical connector; and a plurality of first guide portions disposed on the inner surface of at least one of the two sideboards for guiding insertion of the electrical connecting portion of the electrical apparatus into the complementary mating electrical connector.

The electronic device includes hard disk drives and optical storage devices. The electrical connector may be an electrical inserting slot disposed on the backplane of a server unit for allowing a storage device to electrically connect to the server unit. The guide portions may be a ramp disposed on an inner surface of the sideboard. Thereby, the electrical connection guide member of the invention can solve the problem of the prior art in which electrical connecting portions are difficult to connect to the back plane of a server unit due to the inherent difference existing therebetween or awkwardly located positions.

The electrical connection guide member of the present invention, which compared to the known guiding mechanisms that are typically incorporated with the connectors, has the advantage of being capable of tolerating relatively larger differences as it has a substantially ring-shaped receptacle constituted by a connecting board connecting with two sideboards, to sleeve and cover on the outside of a mating connector, thereby allowing a wide range of electrical connecting portions to be connected with the connector.

Also, there exists a concern of insufficient coupling between arm portions and an electrical connector. In contrast to the known guiding means used for guiding connectors of electronic cards, the electrical connection guide member of the present invention, as described above, has a substantially ring-shaped receptacle to sleeve and cover a mating connector, and further is provided with retention structures and a fixing portion to assure secure coupling with the connector.

In a preferred embodiment of the invention, the first retention portion is a protrusive eaves disposed at the top end of one side of the mating connector, although not limited to that configuration, and the second retention portion is a recess formed on an inner surface of either one of the sideboards to correspondingly couple with the protrusive eaves, thereby vertically fixing and covering the guide body on the mating connector. The fixing portion may be an inverted hook disposed at the end of the sideboard to hook up with the mating connector.

In comparison with the guiding device of known electronic cards that requires using long clamping arms for providing rigidity, the electrical connection guide member of the present invention has a second retention portion and a fixing portion constituted of a recess and an inverted hook respectively formed on the sideboards, thereby reducing material usage and cost.

In that the electrical connection guide member of the present invention, as described above, can eliminate the use of clamping arms that are usually in the shape of long projective structures, and can be substantially or fully integrally formed, it is, therefore, applicable to molding for ease of production and has high industrial applicability.

BRIEF DESCRIPTION OF DRAWINGS

The invention, together with its objectives and the advantages thereof, may be better understood by reference to the following description taken in conjunction with the accompanying drawings, in which like reference numerals identify like elements in the figures, wherein.

DETAILED DESCRIPTION OF PREFERRED EMBODIMENTS

First Preferred Embodiment

In order to specifically illustrate the present invention, including the technology, structure, traits, aims and efficiency, a detailed explanation of a preferred embodiment of the present invention will be given hereinafter, with reference to the annexed drawings, for better understanding thereof for those skilled in the art.

Figure 1:
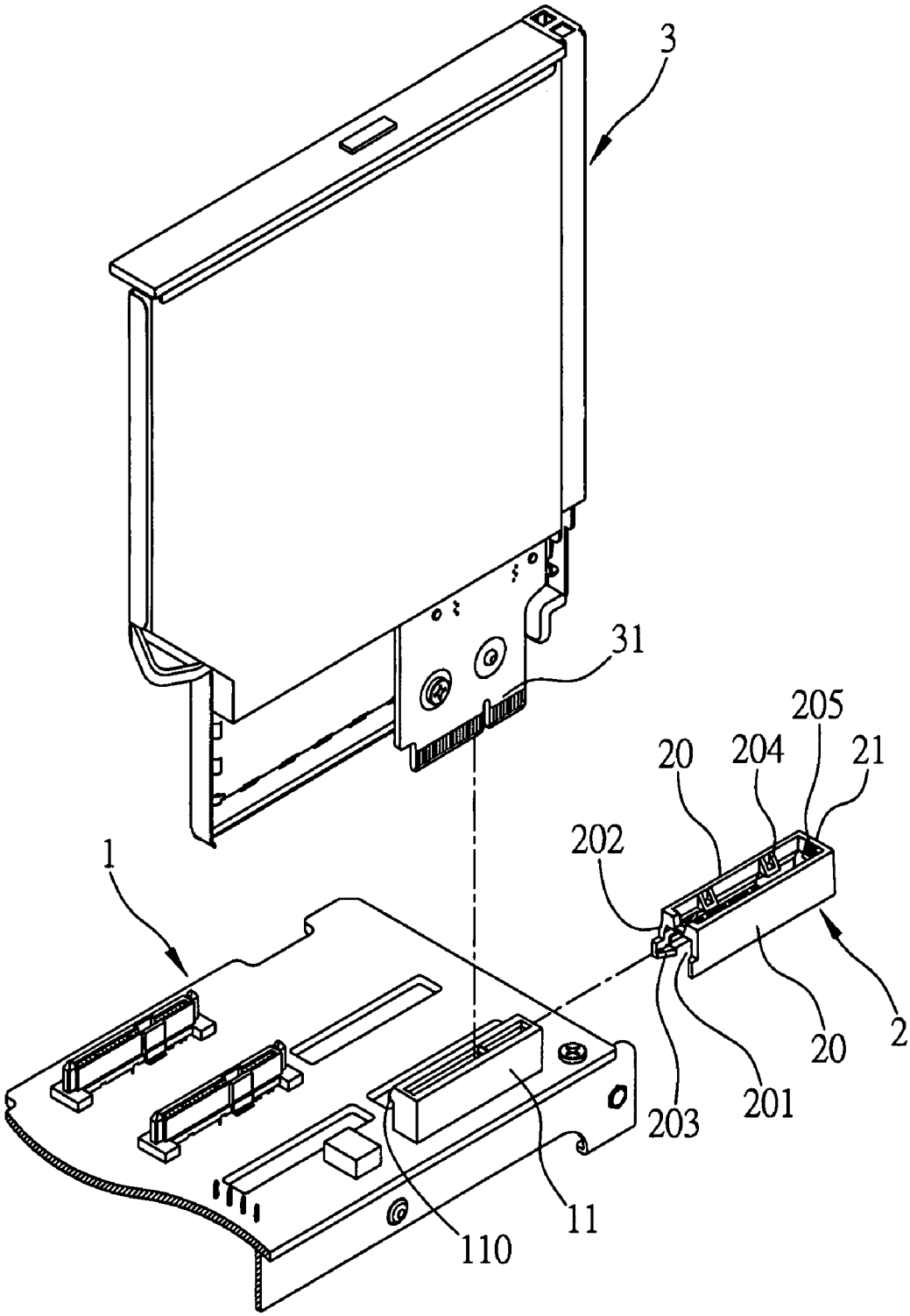
FIG. 1 is a perspective view showing a first preferred embodiment of the electrical connection guide member being applied to connecting with an electrical connector of an electronic device in accordance with the invention.

Referring to the drawings in greater detail, and first to FIG. 1, the invention is embodied in an electrical connection guide member 2 for guiding insertion of an electrical connecting portion 31 of an electronic device 3 into a (complementary mating) electrical connector 11 disposed on a printed circuit board 1, wherein the side wall of the electrical connector 11 comprises a first retention portion 110. The electrical connection guide member 2 comprises: a connecting board 21; and two sideboards 20 each vertically connecting with two ends of the connecting board 21 and opposing one another to form a rectangle-shaped receptacle with the connecting board for accommodating the connector 11 therein. Two opposed ends at one end of the two sideboards 20 further constitute an opening 201 connected with the rectangle-shaped receptacle for receiving the complementary mating electrical connector 11. Moreover, a second retention portion 202 is disposed on the inner surface of the sideboards 20 corresponding to the first retention portion 110; a fixing portion 203 is disposed on the sideboard 20 corresponding to the opening 201 for fixing the complementary mating electrical connector 11; and a plurality of first guide portions 204 are disposed on the inner surface of at least one of the two sideboards 20 for guiding insertion of the electrical connecting portion 31 into the complementary mating electrical connector 11.

In one embodiment of the invention, the printed circuit board 1 may be a backplane disposed in a server unit (not shown). The electrical connecting portion 31 may be an electrical inserting slot disposed on the backplane of the server unit. The first retention portion 110 may be a protrusive eaves disposed at the top of one side of the electrical connector 31. The electronic device 3 includes hard disk drives and optical storage devices; wherein the electrical connecting portion 31 thereof electrically connects to the connector 11 to electrically connect the storage device to the main board of the server unit.

The connector 11 may be in a rectangular block shape. The sideboards 20 and the connecting board 21 each correspond to the long sides and the short connecting side of the connector 11, respectively. In practical application, the connecting angle of the sideboards 20 and the connecting board 21 is not limited to be strictly vertical and can be a little larger or smaller than 90 degrees depending on the requirements.

Also note that the application of the electrical connection guide member 2 is not limited to the disclosure described above. For instance, the electronic device may be a PCI card or an electronic device that has an electrical connecting portion, and the circuit board 1 may be a main board or other printed circuit board equipped with electrical connectors. The electrical connection guide member 2 can smoothly connect with the connector along with the insertion of a storage device via its guide portions, thereby overcoming the difficulty in connecting a storage device to the backplane of a server unit due to differences existing therebetween.

Figure 2:
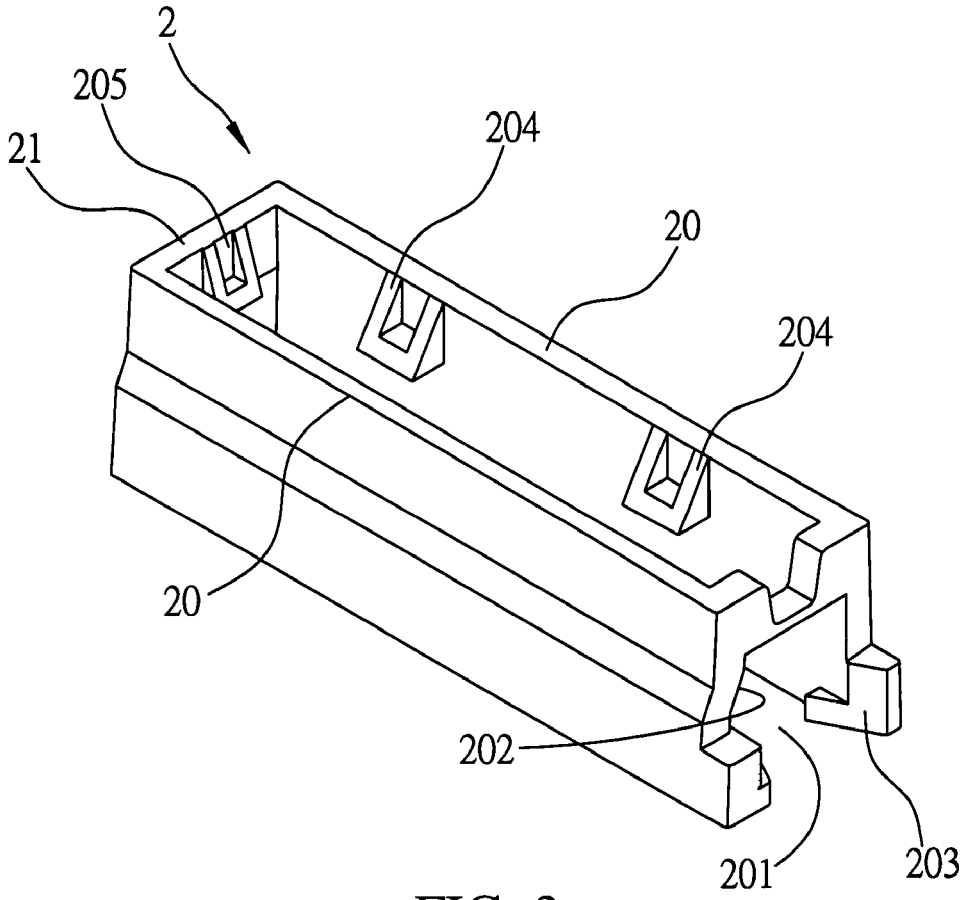
FIG. 2 is an isogonal perspective view of the electrical connection guide member in accordance with the invention.

Referring in conjunction with FIG. 2, the first guide portion 204 may be a ramp disposed on an inner surface adjacent to the top end of the sideboards 20, and the ramp may be a wedge-shaped protruding block. Also, the connecting board 21 may include at least a second guide portion 205 disposed in a manner similar to the first guide portion 204.

In another embodiment of the invention, the fixing portion 203 may be an inverted hook disposed at each end of the sideboards 20, respectively. The inverted hook is used to hook to one side of the electrical connector 11 for horizontally fixing the electrical connection guide member 2 and the electrical connector 11 to increase rigidity.

Figure 3:
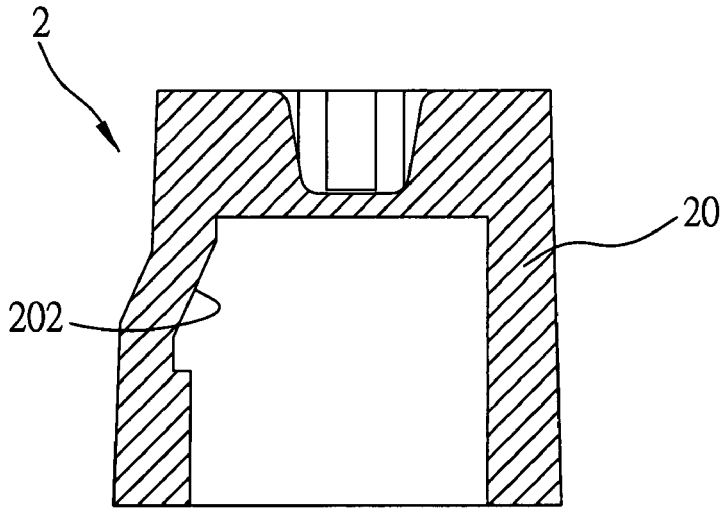
FIG. 3 is a side cross-sectional view of the electrical connection guide member in accordance with the invention.

Referring in conjunction with FIG. 3, the second retention portion 202 may be a recess formed on an inner surface of one of the sideboards 20 to correspondingly couple with the protrusive eaves of the first retention portion 110 that is disposed at the top end of one side of the complementary mating electrical connector 11, thereby vertically fixing and covering the sideboards 20 on the complementary mating electrical connector 11 by coupling the recess to the protrusive eaves.

In comparison with the typical guiding device of known electronic cards that requires long clamping arm for providing rigidity, the electrical connection guide member of the present invention, as described above, has a second retention portion and a fixing portion constituted by a recess and an inverted hook, respectively, that are formed on the sideboards, thereby reducing material usage and lowering costs.

Second Preferred Embodiment

Figure 4:
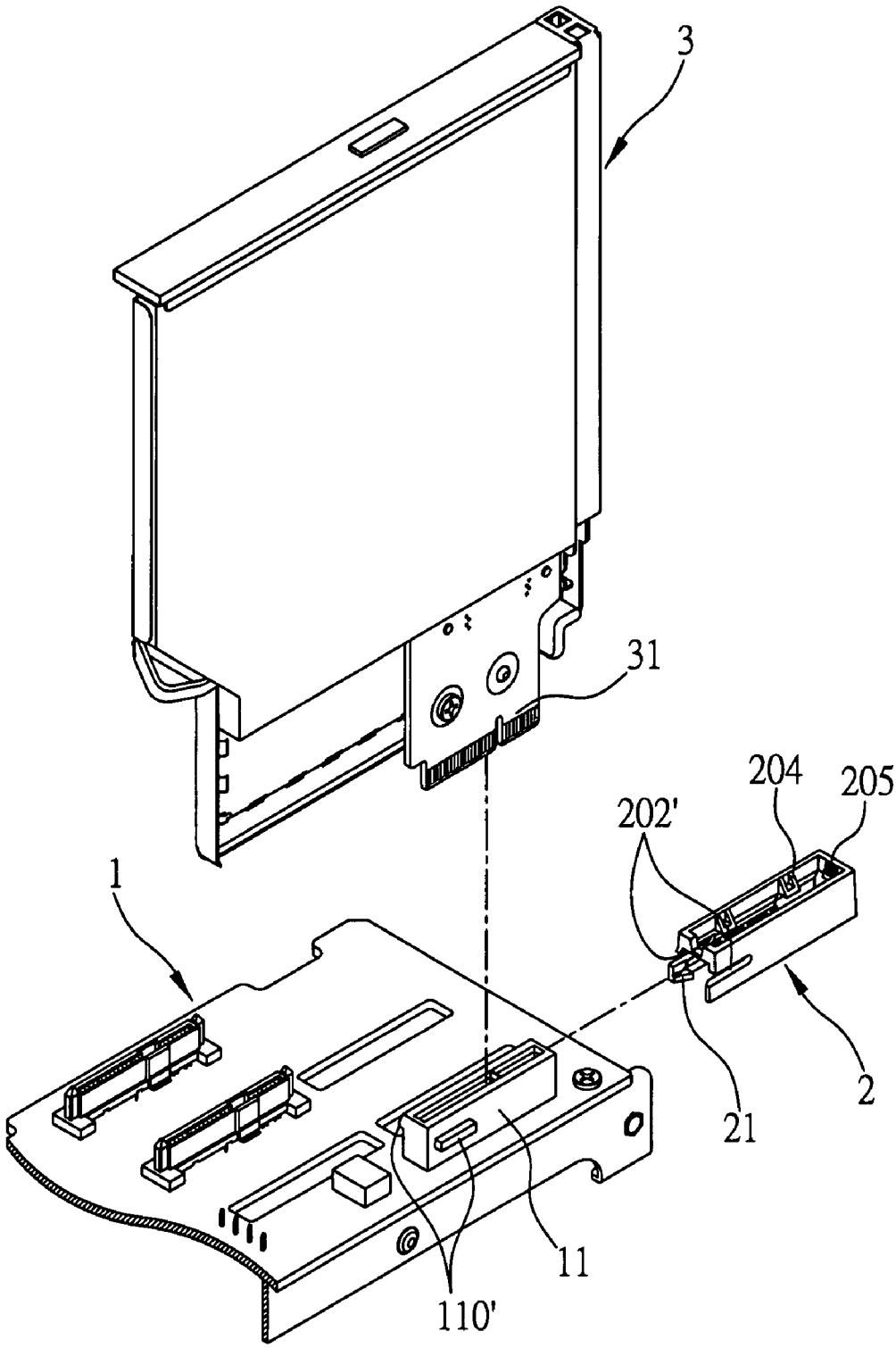
FIG. 4 is a perspective view showing a second preferred embodiment of the electrical connection guide member being applied to connecting with an electrical connector of an electronic device in accordance with the invention.

FIG. 4 depicts a second preferred embodiment of the electrical connection guide member according to the present invention. The structure of the second preferred embodiment is substantially the same as that of the first preferred embodiment, and only differs in that the first retention portion 110' in this embodiment not only includes a protrusive eaves disposed on the top of one side of the electrical connector 11, but also comprises a rib protrusion disposed on the other outer side of the electrical connector 11. The second retention portion 202' further comprises a horizontal slot disposed on the two sideboards at a position close to an opposing end of the connecting board 21 and corresponding to the rib protrusion, thereby strengthening the guide member 2 in the vertical direction (i.e., restricting vertical movement) and also preventing either end of the sideboards 20 from becoming crooked or warped. Note that the first retention portion 110' may comprise only rib protrusions disposed on the two sides of the electrical connector 11 while the second retention portion 202' includes a horizontal groove disposed on the two sideboards 20 corresponding to rib protrusions.

Summarizing the above, to couple the electrical connection guide member 2 of the invention to the mating connector 11, first, the receiving opening 201 of the electrical connection guide member 2 is moved horizontally towards one end of the connector 11 to place and insert the protrusive eaves of the first retention portion 110 (or 110') into the recess of the second retention portion 202 (or 202'). Note that the receiving opening 201 needs to couple to the connector 11 from the other end away from the rib protrusion in the second preferred embodiment. Next, the connector 11 is moved horizontally to abut against the surface of the sideboards 20 and slightly expand the receiving opening 201 to deform the sideboards 20 until the inverted hook of the fixing portion passes over the connector 11 and releases the pressure to hook up with one end of the connector 11. The deformed sideboards 20 return to its original shape and tightly connect the guide member 2 to the connector 11. Conversely, it requires only pushing the inverted hook of the fixing portion 203 out of its two sides so as to push and detach the electrical connection guide member 2 from the connector 11.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connection guide member for guiding insertion of an electrical connecting portion of an electronic apparatus to a complementary mating electrical connector having a first retention portion provided on at least one of two sidewalls thereof, comprising:

a connecting board having two opposed ends and an inner surface;

two opposed sideboards each having a first end, a second end and an inner surface, the two opposed sideboards being vertically connected with the two opposed ends of the connecting board at the first end, to form with the connecting board a rectangle-shaped receptacle for accommodating the complementary mating electrical connector, the second ends of the two sideboards constituting a receiving opening abutting the rectangle-shaped receptacle for receiving the complementary mating electrical connector therein;

a second retention portion disposed on the inner surface of one of the two opposed sideboards and corresponding to the first retention portion of the complementary mating electrical connector;

at least one fixing portion disposed on one of the sideboards and corresponding to the receiving opening for fixing the complementary mating electrical connector; and at least one first guide portion disposed on the inner surface of one of the two sideboards for guiding insertion of the electrical connecting portion of the electrical apparatus into the complementary mating electrical connector.

2. The electrical connection guide member of claim 1, wherein the first retention portion is a protrusive eaves disposed at a top end of a side wall of the complementary mating electrical connector, and the second retention portion is a recess formed on the inner surface of one of the two sideboards and corresponding to the protrusive eaves.

3. The electrical connection guide member of claim 2, wherein the first retention portion further comprises rib protrusions disposed on two sides walls of the complementary mating electrical connector, and the second retention portion further comprises a horizontal slot disposed on the two sideboards and corresponding to the rib protrusions.

4. The electrical connection guide member of claim 1, wherein the first retention portion is rib protrusions respectively disposed on two sides of the complementary mating electrical connector, and the second retention portion is a horizontal slot disposed on the two opposed sideboards and corresponding to the rib protrusions.

5. The electrical connection guide member of claim 1, wherein the fixing portion comprises a conjugated hook disposed at the second end of the sideboard respectively for hooking up with the complementary mating electrical connector.

6. The electrical connection guide member of claim 1, wherein at least one of the first guide portions is in the form of a wedge protrusion.

7. The electrical connection guide member of claim 1 further comprising a second guide portion disposed on the inner surface of the connecting board and close to a top end of the connecting board.

8. The electrical connection guide member of claim 7, wherein the second guide portion is in the form of a wedge protrusion.

* * * * *